United States Patent [19]

Hyodo et al.

[11] Patent Number: 4,986,201

[45] Date of Patent: Jan. 22, 1991

[54] SEWING MACHINE CAPABLE OF SETTING A FABRIC FEED TO ZERO AT THE BEGINNING OF SEWING OPERATION

[75] Inventors: Toru Hyodo; Akiyoshi Sasano, both of Tokyo, Japan

[73] Assignee: Janome Sewing Machine Company Limited, Tokyo, Japan

[21] Appl. No.: 399,705

[22] Filed: Aug. 28, 1989

[30] Foreign Application Priority Data

Aug. 26, 1988 [JP] Japan ..... 63-210516

[51] Int. Cl.[5] ..... D05B 3/02

[52] U.S. Cl. ..... 112/456

[58] Field of Search ..... 112/456, 453, 451, 317, 112/315, 314, 277, 235, 121.11, 275

[56] References Cited

U.S. PATENT DOCUMENTS 4,142,474 3/1979 Bowles ..... 112/451
4,147,119 4/1979 Dunn ..... 112/317
4,393,795 7/1983 Makabe et al. ..... 112/456 X

*Primary Examiner*—Peter Nerbun

*Attorney, Agent, or Firm*—Frishauf, Holtz, Goodman & Woodward

[57] ABSTRACT

A sewing machine capable of setting a feed pitch of a first stitch on zero in a work piece at the beginning of sewing operation, comprises: a needle reciprocable in a vertical direction and joggable in a lateral direction; a feed means which cooperates with a presser foot in operation in synchronism with the needle for feeding a work piece at a desired rate; a stitch-forming mechanism driven by a main drive motor of the sewing machine; a motor-operation detecting means for detecting operating conditions of the main drive motor; a needle-position detecting means for detecting a position of the needle having been disposed above a throat plate; and a presser-foot position detecting means for detecting a position of the presser foot relative to the throat plate, whereby a feed pitch of the feed means is set on zero at a time when the motor-operation detecting means detects a stopping condition of the main drive motor, so that a condition in which the feed pitch of the feed means is set on zero is held until a subsequent feed-control data is inputted.

3 Claims, 11 Drawing Sheets

SEWING MACHINE CAPABLE OF SETTING A FABRIC FEED TO ZERO AT THE BEGINNING OF SEWING OPERATION

BACKGROUND OF THE INVENTION

1. Field of the Invention:

The present invention relates to a sewing machine capable of adjusting a feed pitch or stitch length in a work piece, and more particularly to a sewing machine capable of setting the feed pitch or stitch length of a first stitch to zero in the work piece at the beginning of a sewing operation.

2. Description of the Prior Art:

A conventional sewing machine is constructed of: a sewing needle which is reciprocable in a vertical direction and swingable in a lateral direction, when the needle is above a work piece to be sewn; a thread to form stitches; feed means which cooperates with a presser foot in synchronism with the needle to feed the work piece through a so-called parallelogramic four-step motion; and driving means for driving these components of the sewing machine. The work feed means includes a feed dog for feeding the work with respect to the needle when the feed dog is disposed above a throat plate which supports the work piece while the fabric or work is pressed against the throat plate by a vertically reciprocable presser foot.

As is apparent from the above, the needle is disposed in a position above the throat plate when the feed dog is moved upward from the throat plate, so that, the feed pitch or stitch length is regulated while the needle is disposed in a position below the throat plate to enable the needle-thread catching means to catch the needle thread to form a stitch. After completion of regulation of the feed pitch or stitch length, the needle moves upward and the feed dog moves upward from the throat plate to feed the work piece at a rate of the regulated feed pitch or stitch length.

Horizontal feed of the work piece conducted by the feed dog continues until the needle is moved halfway down to the throat plate or the work from a subsequent stitch.

Namely, the feed dog or the feed means is so constructed as to make substantially a half of a total work feed stroke when the needle is positioned in the vicinity of an upper dead point of the needle, in which position the needle may be laterally swingable and the remaining half of the stroke of the feed dog continues to feed the work until the needle moves down half way to the work piece.

The conventional sewing machine having the above construction has a problem in that: in case a plurality of small constituent patterns are optionally combined to form a large-sized pattern, it is impossible to correctly determine a needle position for the first stitch of the subsequent pattern after completion of a sewing operation of a first one of the constituent patterns, since, as mentioned above, the feed dog of the feed means continues to make the remaining half of its work feed stroke of the last stitch of the precededly sewn pattern while the needle comes down to the work.

In order to resolve the above problem, another conventional sewing machine, for example such as one proposed in Japanese Patent Laid-Open Nos. 61-279284 and 61-272083 is provided with a means for setting a feed pitch of the last stitch on zero at the end of a sewing operation of one of the constituent patterns to enable the sewing needle to begin to stitch the work piece at the desired point of the work piece in the subsequent sewing operation of a next one of the constituent patterns.

However, in general, in sewing operation, not only the constituent patterns but also continuous straight stitch, zigzag stitch as shown in FIG. 10 (*a*) and like stitches are frequently employed in the sewing machine.

In addition, in sewing operation of the large-sized pattern, it is often required to stop the sewing operation of one of the constituent patterns before completion of such sewing operation.

For example, in case that a first sewing operation of a zigzag stitch or pattern having a stitch length "c" and stitch width "W" is stopped at a point "a" as shown in FIG. 10 (*b*), a subsequent sewing operation of the same zigzag stitch starts at a point "b1" spaced apart from the point "b" as shown in FIG. 10 (*b*), because the stitch length is automatically set on zero at the end of the first sewing operation to cause a first stitch of the subsequent sewing operation to have no stitch length.

Then, the stitch length "c" of the pattern is set when the sewing needle point is disposed in a position below the throat plate to make it possible that a second stitch of the subsequent sewing operation has a stitch length "c". Consequently, in the conventional sewing machine, in case that the sewing operation of a pattern is temporarily stopped, it is impossible to start a sewing operation forming the pattern in continuous manner.

SUMMARY OF THE INVENTION

It is an object of the present invention to provide a sewing machine in which: even when the sewing operation of a pattern is temporarily stopped, it is possible to start a sewing operation forming the pattern in a continuous manner; and, in case that a plurality of small constituent patterns are combined to form a large-sized pattern, after completion of a sewing operation of one of the constituent patterns, it is possible to form a first stitch of a subsequent sewing operation of a next one of the constituent patterns at a desired position of the work piece having been aligned with the sewing needle.

The above object of the present invention is accomplished by providing:

A sewing machine capable of setting a feed pitch or stitch length of a first stitch on zero in a work piece at the beginning of sewing operation, comprising:

a sewing needle reciprocable in a vertical direction and joggable in a lateral direction;

a feed means which cooperates with a presser foot in operation in synchronism with the sewing needle for feeding a work piece at a desired variable rate;

a stitch-forming mechanism driven by a main drive motor of the sewing machine;

a motor-operation detecting means for detecting operating conditions of the main drive motor;

a needle-position detecting means for detecting a position of the sewing needle having been disposed above a throat plate; and a presser-foot position detecting means for detecting a position of the presser foot relative to the throat plate;

whereby a feed pitch of the feed means is set on zero at a time when: the motor-operation detecting means detects a stopping condition of the main drive motor; the needle-position detecting means detects a raised position of the needle disposed above the throat plate; and the presser-foot position detecting means detect a release position of the presser foot disposed in a position above the throat plate, so that a condition in which the feed pitch of the feed means is set on zero is held until a subsequent feed-control data is inputted.

Further, the above object of the present invention is accomplished by providing:

A sewing machine capable of setting a feed pitch or stitch length of a first stitch on zero in a work piece at the beginning of sewing operation, comprising:

a sewing needle reciprocable in a vertical direction and joggable in a lateral direction;

a feed means provided with a feed dog which cooperates with a presser foot in operation in synchronism with the sewing needle for feeding a work piece at a desired variable rate, the feed means being provided with a feed regulator providing a specific phase corresponding to a neutral position of the feed dog, in which neutral position the feed dog is kept substantially stationary;

a stitch-forming mechanism driven by a main drive motor of the sewing machine;

a pattern-selecting means for selecting a desired pattern from a plurality of predetermined various patterns stored in a pattern-data memory means;

a motor-operation detecting means for detecting operating conditions of the main drive motor;

a needle-position detecting means for detecting a position of the sewing needle having been disposed above a throat plate; and a presser-foot position detecting means for detecting a position of the presser foot relative to the throat plate;

whereby a feed pitch of the feed means is set on zero at a time when: the motor-operation detecting means detects a stopping condition of the main drive motor; the needle-position detecting means detects a raised position of the needle disposed above the throat plate; and the presser-foot position detecting means detects at least one of facts that a release position of the presser foot disposed in a position above the throat plate is detected and the operation of the pattern-selecting means is detected in the specific phase, so that a condition in which the feed pitch of the feed means is set on zero is held until a subsequent feed-control data is inputted.

Futhermore, the above object of the present invention is accomplished by providing:

A sewing machine capable of setting a feed pitch or stitch length of a first stitch on zero in a work piece at the beginning of sewing operation, comprising:

a sewing needle reciprocable in a vertical direction and joggable in a lateral direction;

a feed means provided with a feed dog which cooperates with a presser foot in operation in synchronism with the sewing needle for feeding a work piece at a desired variable rate;

a stitch-forming mechanism driven by a main drive motor of the sewing machine;

a pattern-selecting means for selecting a desired pattern from a plurality of predetermined various patterns stored in a pattern-data memory means;

a feed-dog depressing mechanism capable of switching an up-and-down feed motion of the feed dog from effective condition to disabled condition;

a motor-operation detecting means for detecting operating conditions of the main drive motor; and a needle-position detecting means for detecting a position of the sewing needle having been disposed above a throat plate;

whereby the up-and-down feed motion of the feed dog is switched into the disabled condition at a time when: the motor-operation detecting means detects a stopping condition of the main drive motor; the needle-position detecting means detects a raised position of the needle disposed above the throat plate; and operation of the pattern-selecting means is detected, so that a condition in which the up-and-down feed motion of the feed dog is switched into the disabled condition is held until a subsequent feed-control data is inputted.

DESCRIPTION OF THE PREFERRED EMBODIMENTS

Figure 1:
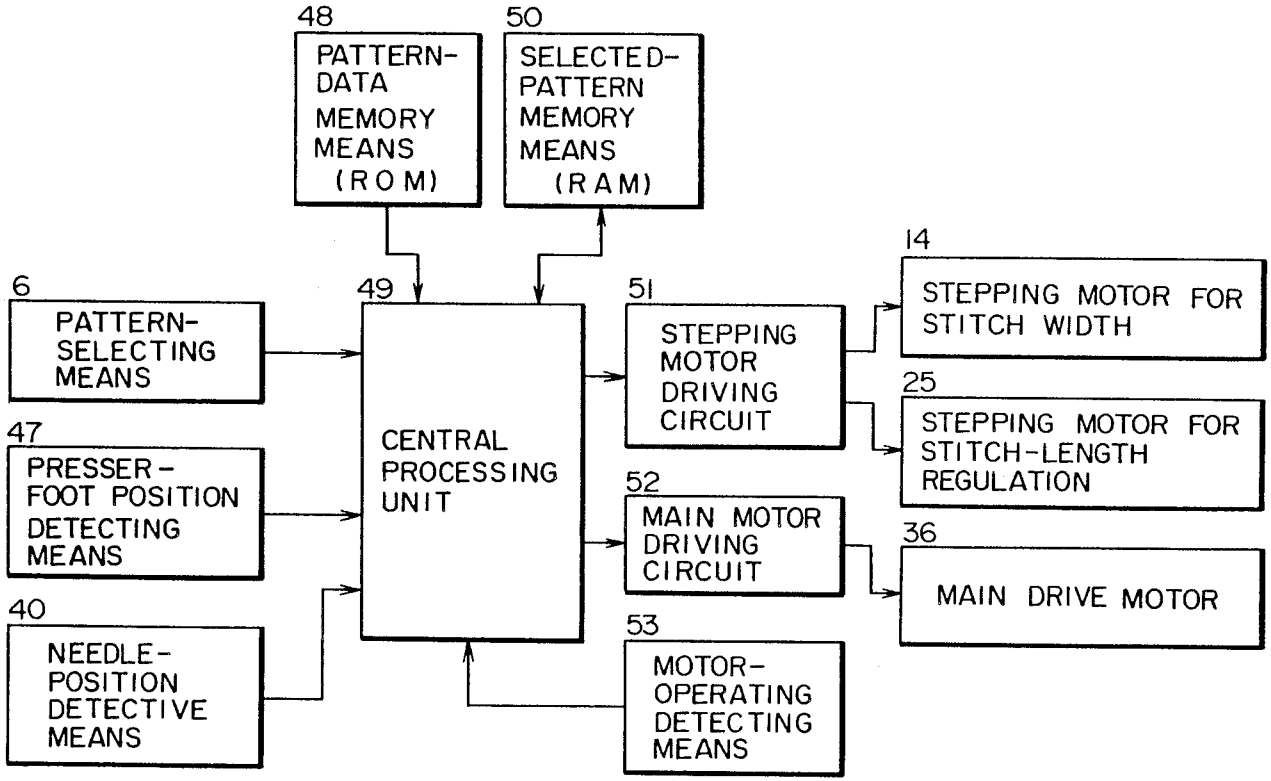
FIG. 1 is a block diagram view of a control system of a first embodiment of the sewing machine of the present invention.

Now, embodiments of a sewing machine of the present invention will be described in detail hereinbelow with reference to the accompanying drawings in which: the reference numeral 17 denotes a sewing needle; 20 a presser foot; 53 a motor-operation detecting means; 40 a needle-position detecting means; and 47 a presser-foot position detecting means.

Figure 3:
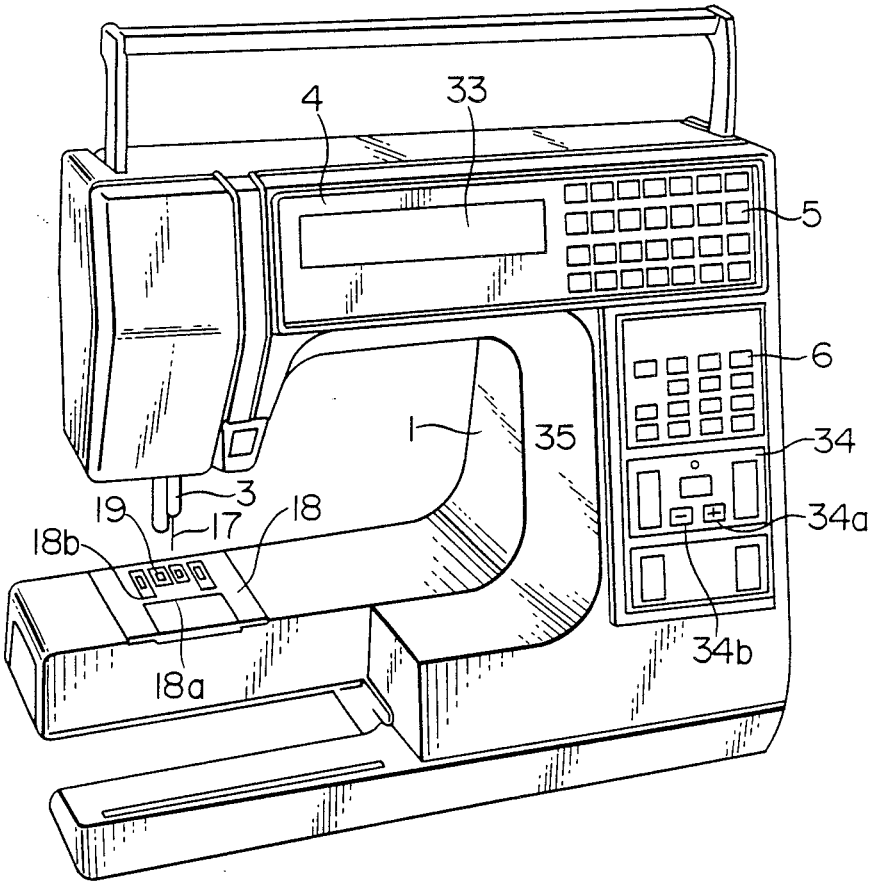
FIG. 3 is a perspective view of the sewing machine of the present invention.
Figure 4:
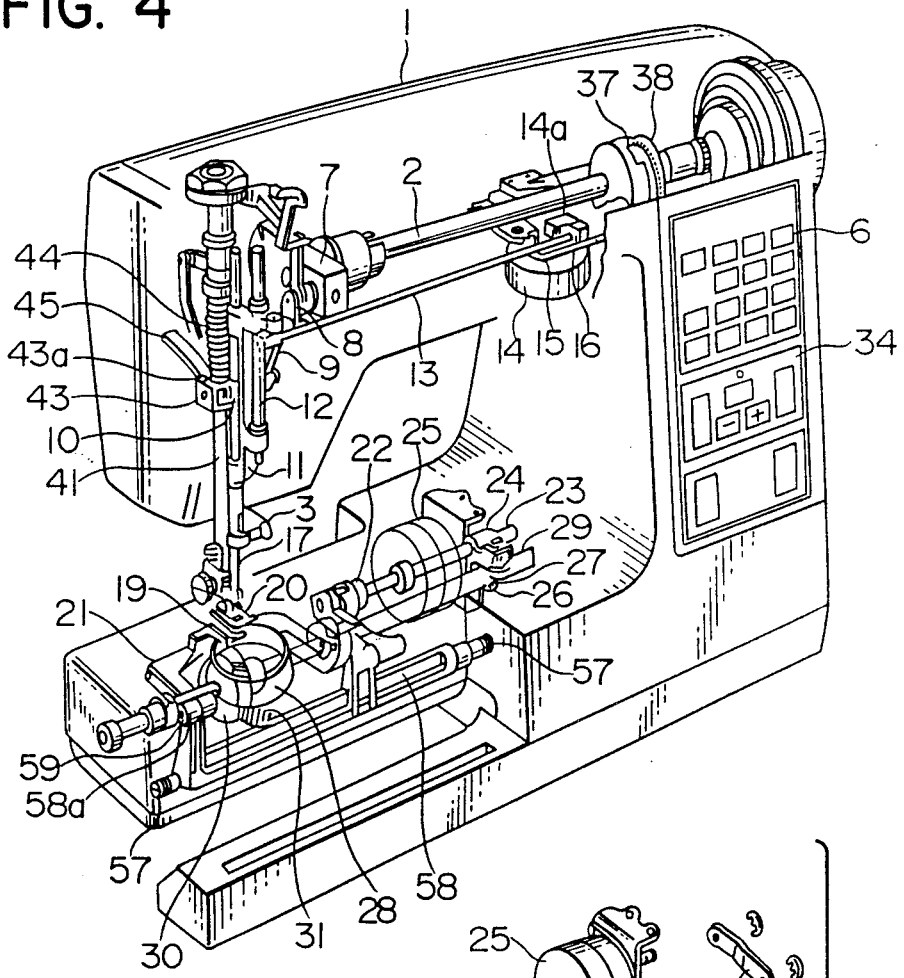
FIG. 4 is a view illustrating the construction of the sewing machine of the present invention.

As shown in FIGS. 3 and 4, in the sewing machine of the present invention, a drive shaft 2 of a main drive motor 36 is rotatably mounted in a machine frame 1 of the sewing machine. On the other hand, a needle bar 3 is connected with the drive shaft 2 while so mounted in the machine frame 1 as to be reciprocable in a vertical direction and joggable in a lateral direction. As shown in FIG. 3, a front panel 4 is fixedly mounted on the machine frame 1, in which front panel 4 are disposed: a pattern display section 5 for displaying a plurality of predetermined patterns stored in a memory of the sewing machine, the patterns varying in stitch width and stitch length in construction; a pattern-selecting means 6; and a selected-pattern display section 33 for displaying a pattern selected from the above predetermined patterns.

In the front panel 4, a manual-control means 34 is disposed in a position under the pattern-selecting means 6, and manually operated by the operator. In the manual-control means 34 are provided: a positive-feed key 34*a* for increasing a feed pitch or stitch length of stitches employed in the predetermined patterns stored in the memory of the sewing machine; and a negative-feed key 34*b* for decreasing the feed pitch or stitch length mentioned above. The reference numeral 35 shown in FIG. 3 denotes a zero-start displaying LED (light emitting diode) for displaying a condition in which a feed pitch or stitch length of the feed dog is set on zero.

The main drive motor 36 of the sewing machine of the present invention is fixedly mounted on the machine frame 1, while connected with the drive shaft 2 through a suitable coupling means.

Now, construction of the sewing machine of the present invention will be described in detail with reference to FIG. 4.

As shown in FIG. 4, the reciprocating needle bar 3 is fixedly mounted in a needle-bar guide 10 in an insertion manner. The needle-bar guide 10 is rotatably mounted on an end portion of a crank rod 9 the other end portion of which is rotatably connected with a shaft portion of a needle-bar crank 8 which is so fixedly mounted on an end portion of a crank 7 as to be eccentrically disposed with respect to the drive shaft 2 rotatably mounted in the machine frame 1. More particularly, the needle bar 3 is inserted into a needle-bar supporting element 11 at an upper and a lower portion of the needle-bar guide 10 so as to be vertically movably supported by the element 11.

An end portion of the needle-bar supporting element 11 is connected with an end portion of a connecting rod 13 the other end portion of which is connected with an arm 15 through a link 16. The arm 15 is fixed to an output shaft 14*a* of a stepping motor 14 which is employed for jogging a sewing needle 17 in a lateral direction to provide a stitch width. The stepping motor 14 is fixedly mounted in the machine frame 1. The sewing needle 17 is fixedly mounted on a front end of the needle bar 3, and so formed as to pass through a throat 18*a* of a throat plate 18 which is mounted on the machine frame 1. The reference numeral 19 denotes a feed dog, and so constructed as to be able to pass through a feed-dog slot 18*b* of the throat plate 18 for extending upward from the throat plate 18. The feed dog thus extended upward from the throat plate 18 cooperates with a presser foot 20 to feed the work piece or cloth being sewn.

The feed dog 19 is fixedly mounted on a lateral-feed arm 21 which is driven by the drive shaft 2. Regulation of an amount of lateral feed of the feed dog 19 is accomplished by regulating a swing angle of the lateral-feed arm 21. A feed regulator 22 is fixedly mounted on an end portion of a regulation shaft 23. The swing angle of the lateral-feed arm 21 is regulated by rotating the feed regulator 22. Another arm 24 is fixed to the other end portion of the regulation shaft 23, while connected with a crank 26 through a link 27. The crank 26 is fixedly mounted on an output shaft of another stepping motor 25 for regulating a feed or stitch length. The stepping motor 25 is fixedly mounted in the machine frame 1.

Now, feed regulation conducted by the stepping motor 25 will be described in detail with reference to FIGS. 5 and 6.

Figure 5:
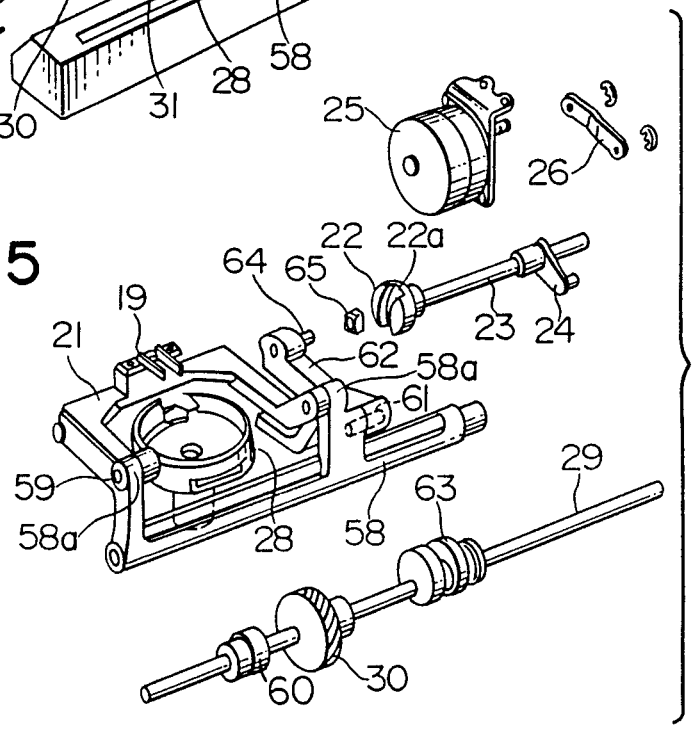
FIG. 5 is a view illustrating the construction of the feed mechanism of the sewing machine of the present invention.
Figure 6A:
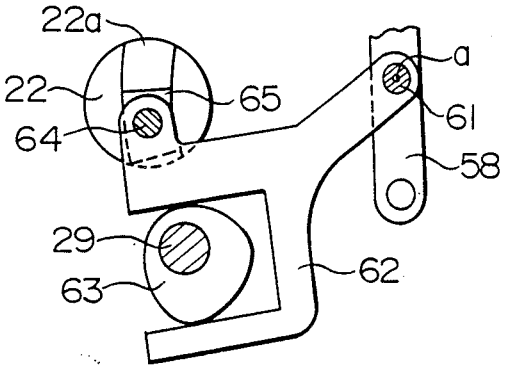
FIG. 6 is a view illustrating operation of feed regulation of the sewing machine of the present invention.
Figure 6B:
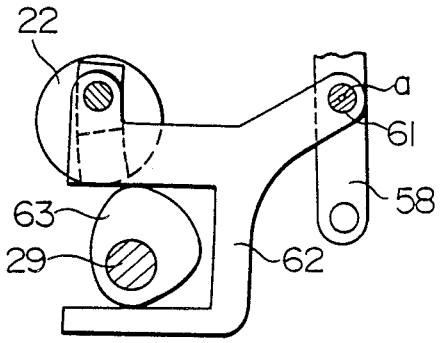
Figure 6C:
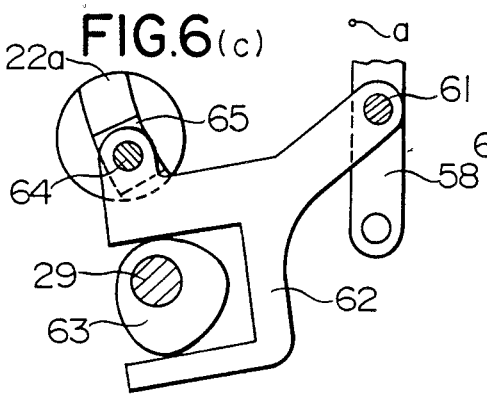
Figure 6D:
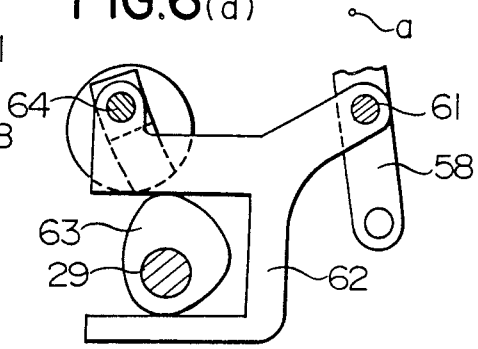
Figure 6E:
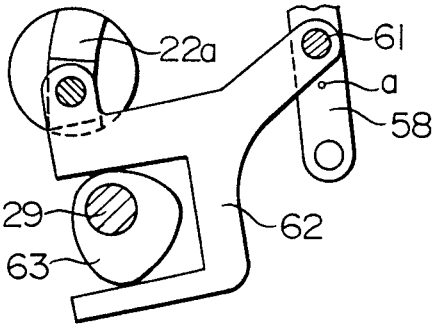
Figure 6F:
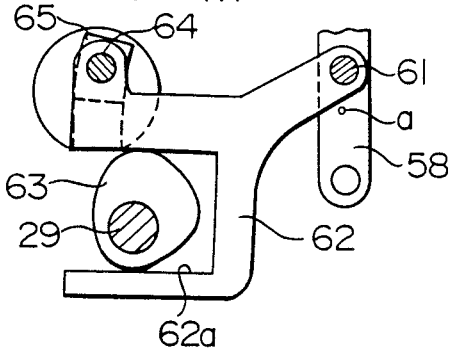

As shown in FIG. 5, the feed dog 19 is fixedly mounted on the horizontal feed arm 21. Other end portions of the horizontal feed arm 21 are rotatably mounted on a pair of pins 59 which are fixed to a pair of arm portions 58*a* of a horizontal feed shaft 58 which is rotatably mounted on a screw center member 57 fixed to the machine frame 1. A lower end portion of the horizontal feed arm 21 is pressed against a feed lifting eccentric 60 by means of a spring means (not shown), which feed lifting eccentric 60 is engaged with a rotating-hook shaft or lower shaft 29.

Consequently, the horizontal feed arm 21 is swung on the pins 59 by the feed lifting eccentric 60 as the rotating-hook shaft 29 rotates, to cause the feed dog 19 to pass through the throat plate 18 upwardly and downwardly.

Fixed to the horizontal feed arm 21 is another pin 61 on which is rotatably mounted an end portion of a feed forked rod 62. In a forked portion 62*a* of the feed forked rod 62 is rotatably mounted a horizontal feed eccentric 63 which is fixed to the rotating-hook shaft 29. On the other hand, as shown in FIG. 5, a forked-rod pin 64 is fixed to an upper end of the forked portion 62*a* of the feed forked rod 62. A square piece 65 is rotatably mounted on the forked-rod pin 64, while slidably mounted in a square-piece groove 22*a* of the feed regulator 22.

FIGS. 6(*a*) and (*b*) show conditions in which the feed regulator 22 sets a feed pitch of the feed dog 19 on zero. FIG. 6(*a*) shows a front-phase position of the feed dog 19, which position is the nearest position to the user of the sewing machine. On the other hand, FIG. 6(*b*) shows a rear-phase position of the feed dog 19, which position is the furthest position from the user of the sewing machine. In a condition shown in FIG. 6(*a*), the horizontal feed eccentric 63 is disposed in its lowest position, while the forked-rod pin 64 fixed to the feed forked rod 62 is disposed in a position under a center of the feed regulator 22. On the other hand, in a condition shown in FIG. 6(*b*), the horizontal feed eccentric 63 is disposed in its upper position, while the forked-rod pin 64 fixed to the feed forked rod 62 is disposed in a position above the center of the feed regulator 22.

As the rotating-hook shaft 29 rotates, the square piece 65 engaged with the forked-rod pin 64 is slidably moved up and down in the square-piece groove 22*a* of the feed regulator 22 as is clear from FIGS. 5 and 6.

Incidentally, in the above conditions shown in FIGS. 6(*a*) and (*b*), a center "a" of a curvature of the square-piece groove 22*a* of the feed regulator 22 is coincident with a center of the pin 61 mounted in an end portion of the feed forked rod 62. Consequently, up-and-down motion of the forked portion 62*a* of the feed forked rod 62 caused by the horizontal feed eccentric 63 is transferred into into a simple rotation of the feed forked rod 62 on the center of the pin 61 to make it impossible to drive the horizontal feed shaft 58 so that the feed dog 19 is not moved laterally, whereby a feed pitch or stitch length is set on zero in the conditions shown in FIGS. 6(*a*) and (*b*).

In conditions shown in FIGS. 6(*c*) and (*d*), a forward feed pitch or stitch length of the feed dog 19 is set on a maximum amount. In the condition shown in FIG. 6(*c*), the feed dog 19 is disposed in the nearest position to the user of the sewing machine. On the other hand, in the condition shown in FIG. 6(*d*), the feed dog 19 is disposed in the furthest position from the user of the sewing machine.

In the conditions shown in FIGS. 6(*c*) and (*d*), the feed regulator 22 has been rotated counterclockwise relative to its previous conditions shown in FIGS. 6(*a*) and 6(*b*), so that the center "a" of curvature of the square-piece groove 22*a* of the feed regulator 22 has been displaced into a position above the pin 61. Consequently, in a condition shown in FIG. 6(*c*) illustrating the nearest position of the feed dog 19 to the user of the sewing machine, the pin 64 of the feed forked rod 62 moves towards the right as the square piece 65 slidably moves downward in the square-piece groove 22*a* of the feed regulator 22. As a result, the horizontal feed shaft 58 is rotatably driven clockwise on the screw center member 57 (shown in FIG. 5) by the feed forked rod 62 through the pin 61. As the horizontal feed shaft 58 rotates clockwise on the screw center member 57 as described above, the horizontal feed arm 21 rotatably connected with the horizontal feed shaft 58 moves towards the right in FIGS. 6(*c*) and (*d*) to bring the feed dog 19 to the nearest position to the user of the sewing machine.

On the other hand, in a condition shown in FIG. 6(*d*) illustrating the furthest position of the feed dog 19 from the user of the sewing machine, the pin 64 of the feed forked rod 62 is moved towards the left relative to the condition shown in FIG. 6(*b*), so that the horizontal feed shaft 58 is rotated counterclockwise on the screw center member 57 (shown in FIG. 5) by the feed forked rod 62 through the pin 61, whereby the horizontal feed arm 21 rotatably connected with the horizontal feed shaft 58 is moved towards the left to bring the feed dog 19 to the furthest position from the user of the sewing machine.

In conditions shown in FIGS. 6(*e*) and (*f*), the feed regulator 22 sets a rearward feed of the feed dog 19 on a maximum amount. In the condition shown in FIG. 6(*e*), the feed regulator 22 is rotated clockwise relative to the condition shown in FIG. 6(*a*), so that the center "a" of curvature of the square-piece groove 22*a* of the feed regulator 22 is displaced into a position under the pin 61. Consequently, when the forked portion 22*a* of the feed forked rod 22 is moved up and down by the horizontal feed eccentric 63, the feed dog 19 performs its rearward feed motion.

When the feed dog 19 is displaced into the nearest position to the user of the sewing machine, an angular position of the drive shaft 2 is substantially 270 degrees, provided that the top dead point of the sewing needle 17 corresponds to an angular position of 0 degree. On the other hand, when the feed dog 19 is displaced into the furthest position from the user of the sewing machine, the angular position of the drive shaft 2 is substantially 90 degrees the feed dog 19 is reciprocated between the nearest position and the furthest position thereof as the rotating-hook shaft or lower shaft 29 rotates. Consequently, in feed motion of the feed dog 19, the pin 64 of the feed forked rod 62 passes through the center of the feed regulator 22 twice per revolution of the drive shaft 2.

Figure 7:
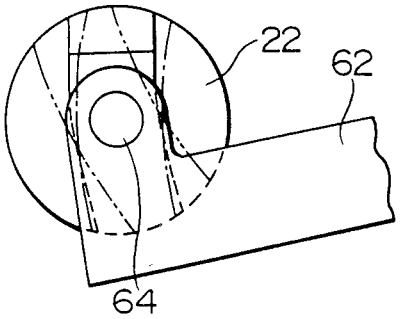
FIG. 7 is a view illustrating a neutral phase of the feed motion conducted in the sewing machine of the present invention.

Such condition occurs when the sewing needle is displaced into its raised position or its depressed position, as shown in FIG. 7. In such condition, it is impossible to move the feed forked rod 62 even when the regulation shaft 23 fixed to the feed regulator 22 is rotated. As a result, under such circumstances, it is also impossible to move the feed dog 19 having been displaced into its neutral position (hereinafter referred to as the neutral phase).

As shown in FIG. 5, a rotating hook 28 serves as a needle-thread catching means, and is rotatably mounted in the machine frame 1 of the sewing machine at a position under the throat plate 18. As shown in FIG. 4, the rotating hook 28 is provided with a rotating-hook bevel gear 31 in its bottom portion, which bevel gear 31 meshes with a rotating-hook shaft bevel gear 30 fixed to the rotating-hook shaft or lower shaft 29 which is rotated in synchronism with the reciprocating needle bar 3 by means of the drive shaft 2.

Figure 8:
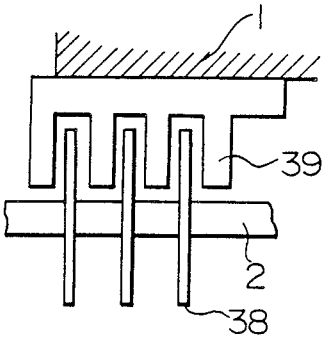
FIG. 8 is a front view of a means for detecting a phase of angular position of the drive shaft of the main drive motor of the sewing machine of the present invention.

As shown in FIG. 8, a means 37 for detecting an angular position of the drive shaft 2 is constructed of: a plurality of disks 38 so fixed to the drive shaft 2 as to be parallelly spaced apart from each other to form a plurality of slits therebetween; a photo interrupter 39 fixedly mounted on the machine frame 1 of the sewing machine. Detecting operation performed by the above means 37 is disclosed in detail in Japanese Patent Laid-Open No. 56-40186, and, therefore is not described here to avoid redundancy in description.

Incidentally, the above means 37 for detecting an angular position of the drive shaft 2 also serves as: the needle-position detecting means 40 for the sewing needle 17; and a means for detecting the above-mentioned neutral phase of the feed dog 19.

As shown in FIG. 4, a presser bar 41 is reciprocably mounted in the machine frame 1 of the sewing machine, while provided with the presser foot 20 at its lower end portion. The presser foot 20 is pressed against the feed dog 19 to cooperate therewith for feeding the work piece to be sewn. The presser bar 41 is slidably mounted in a presser-bar guide 43 between an upper end 43*a* of which and the machine frame 1 is interposed a compression spring 44 through which the presser foot 20 is pressed against the feed dog 19 in sewing operation.

Figure 9:
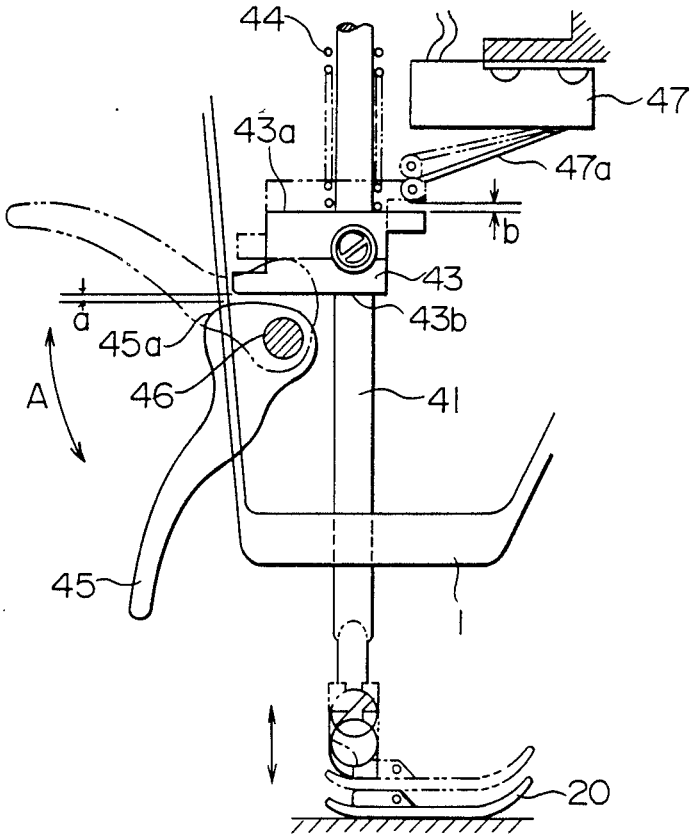
FIG. 9 is a view illustrating operation of the presser-bar lifter of the sewing machine of the present invention.

As shown in FIGS. 4 and 9, a presser-bar lifter 45 is rotatably mounted on a step portion of a stepped screw 46 fixed to the machine frame 1. A shoulder portion 45*a* of the presser-bar lifter 45 is spaced apart from a lower end 43*b* of the presser-bar guide 43 through a clearance "a" in a condition in which the presser foot 20 is pressed against the throat plate 18. In FIG. 9, when the presser-bar lifter 45 is rotated in a direction indicated by an arrow of FIG. 9 so as to be displaced into a position shown in phantom line, the shoulder portion 45*a* of the lifter 45 abuts on the lower end 43*b* of the presser-bar guide 43 to push the presser bar 41 upward against a resilient force exerted by the compression spring 44, whereby the presser foot 20 is displaced into its raised position.

As shown in FIG. 9, a presser-foot position detecting means 47 is constructed of a microswitch fixedly mounted on the machine frame 1. In an off condition of the microswitch 47, the presser foot 20 assumes its depressed position to provide a clearance "b" between a detecting terminal 47*a* of the microswitch 47 and the upper end 43*a* of the presser-bar guide 43. When the presser-bar lifter 45 is operated to displace the presser foot 20 into its raised position, the detecting terminal 47*a* of the microswitch 47 abuts on the upper end 43*a* of the presser-bar guide 43 to turn on the microswitch 47, whereby the fact that the presser foot 20 is displaced into its raised position is detected.

Now, a control section of the sewing machine of the present invention will be described in detail with reference to FIG. 1.

As shown in FIG. 1, a pattern-data memory means (ROM) stores pattern data composed of a stitch width and a stitch length of each of stitches forming various patterns displayed in the pattern display section 5, and is connected with a central processing unit 49. A selected-pattern memory means (RAM) 50 stores patterns selected by the pattern-selecting means 6, and is also connected with the central processing unit 49.

Also connected with the central processing unit 49 are: the pattern-selecting means 6; the presser-foot position detecting means 47; and the needle-position detecting means 40. In addition, the stepping motor 14 for the stitch width and the stepping motor 25 for feed regulation are connected with the central processing unit 49 through a stepping-motor driving circuit 51.

On the other hand, the main drive motor 36 of the sewing machine is connected with the central processing unit 49 through a main motor driving circuit 52. A motor-operation detecting means 53 is employed to detect a driving signal for the main motor driving circuit 52, and is connected with both of the motor-operation detecting means 53 and the central processing unit 49.

Now, operation of the sewing machine of the present invention will be described in detail with reference to the flow diagram shown in FIG. 2.

Figure 10A:
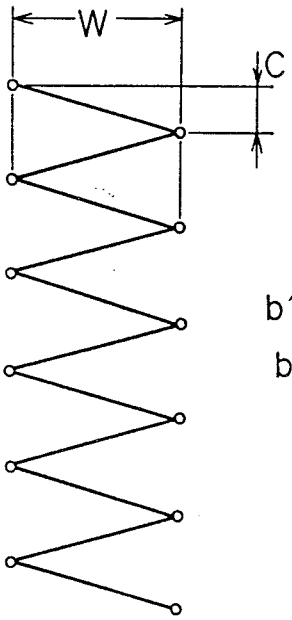
FIGS. 10 (*a*), 10 (*b*) and 10 (*c*) are views illustrating the zigzag stitches.
Figure 10B:
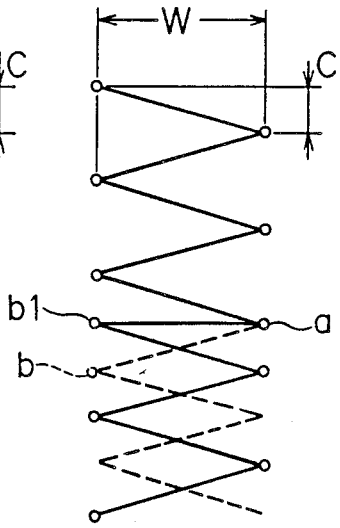
Figure 10C:
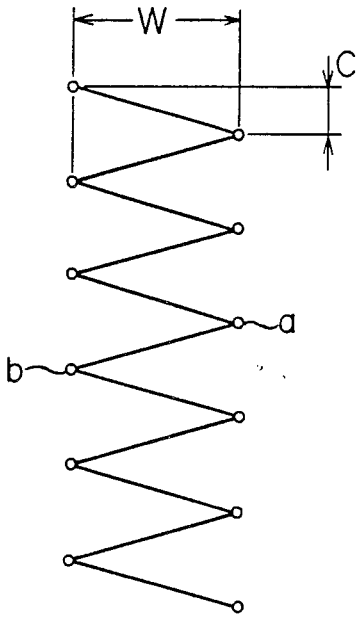

When the pattern-selecting means 6 is operated to select a desired pattern such as the zigzag stitches shown in FIG. 10, the thus selected pattern is stored in the selected-pattern memory means (RAM) 50. Then, the main drive motor 36 is operated through a suitable starting means (not shown) of the sewing machine to rotatably drive the drive shaft 2, so that pattern data is retrieved from the pattern-data memory means (ROM) 48 on the basis of an angular position or phase of the drive shaft 2 detected by the means 37 for detecting an angular position of the drive shaft 2, whereby the stepping motors 14, 25 are operated according to the control data of stitch width and stitch-length.

Incidentally, the stepping motor 14 for providing stitch widths in sewing operation is operated while the sewing needle 17 is displaced into its raised position above the throat plate 18. On the other hand, the stepping motor 25 for stitch length regulation is operated while the point of the sewing needle 17 penetrates the work piece to pass through the throat plate 18 downwardly to bring the feed dog 19 to its depressed position under the throat plate 18.

Figure 2:
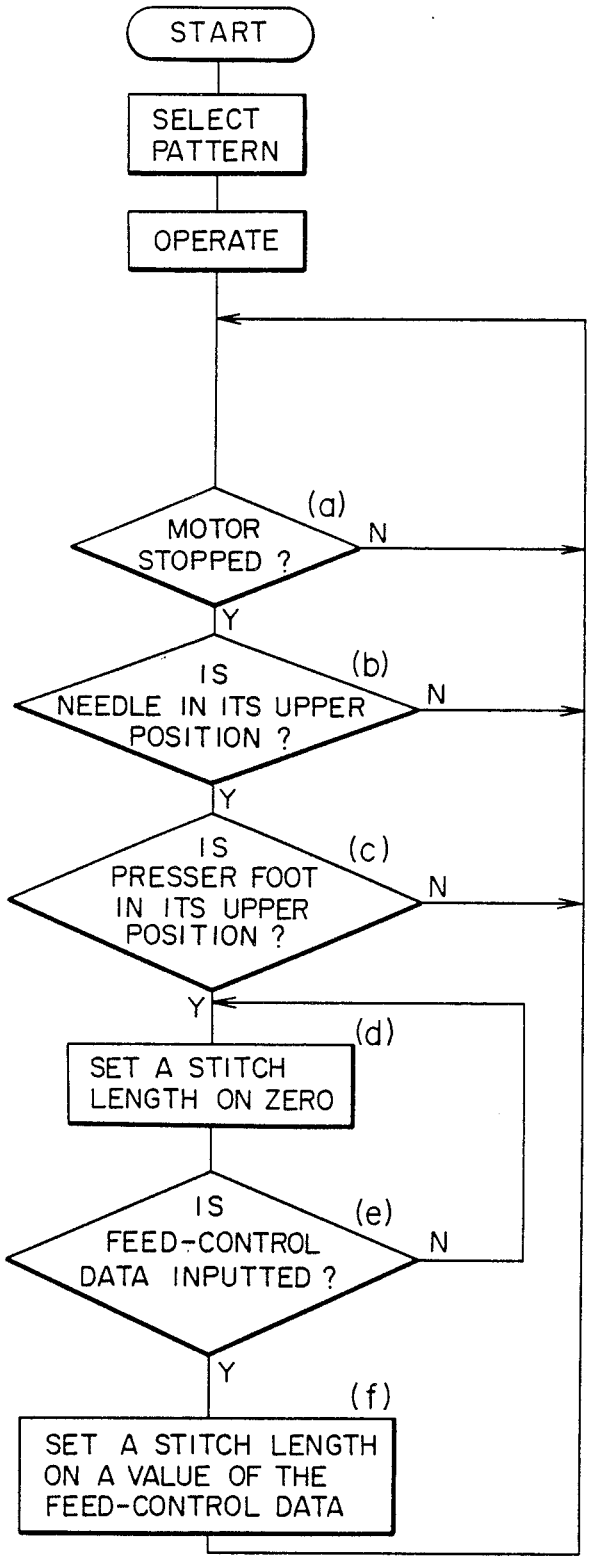
FIG. 2 is a flow diagram (flowchart) illustrating operation of the sewing machine of the present invention shown in FIG. 1.

In a step (a) of the flow diagram shown in FIG. 2, the zigzag stitch is formed according to the pattern data until the motor-operation detecting means 53 detects a stopping condition of the main drive motor 36, which follows an operation condition of the same.

After the stopping condition or no driving signal of the main drive motor 36 is detected by the motor-operation detecting means 53 in the above step (a), the needle-position detecting means 40 judges in a step (b) as to whether or not the sewing needle 17 is displaced into its raised position above the throat plate 18.

In case that the needle-position detecting means 40 detects the fact that the point of the sewing needle 17 is displaced into its depressed position under the throat plate 18, it is judged that the stopping condition of the main drive motor 36 is temporary. As a result, in the flow diagram shown in FIG. 2, the process jumps to a flow line followed by the step (a). On the other hand, in case that the needle-position detecting means 40 detects the fact that the point of the sewing needle 17 is displaced into its raised position above the throat plate 18, the feed dog 19 has accomplished a substantially half of a stroke of its feed motion.

In the step (c) of the flow diagram shown in FIG. 2, the presser-foot position detecting means 47 judges as to whether or not the microswitch constituting the means 47 is turned on. As a result, in case that the main drive motor 36 is judged to be temporarily stopped while the presser-bar lifter 45 is not operated, the process jumps to the flow line followed by the step (a). After that, the main drive motor 36 is operated again so that the feed dog accomplishes the remaining half of the stroke of its feed motion to continuously form the zigzag stitch.

In the above step (c) of the flow diagram shown in FIG. 2, in case that the presser-foot position detecting means 47 detects an ON condition of the microswitch constituting the means 47, the process goes to a subsequent step (d) in which the pattern-data memory means (ROM) 48 issues a "zero-feed" signal to the stepping-motor driving circuit 51 to operate the stepping motor 25 so that the feed regulator 22 is displaced into the position shown in FIGS. 6 (*a*) and (*b*) to disable the feed dog 19.

Under such circumstances, the work piece to be sewn is manipulated to align a desired position thereof with the sewing needle 17, and then the presser-bar lifter 45 is rotated on the stepped screw 46 in a direction counter to the direction indicated by the arrow "A" of FIG. 9 to bring the presser foot 20 to its depressed position.

After that, the feed dog 19 accomplishes the remaining half of the stroke of its feed motion. However, at this time, since the feed pitch of the feed dog 19 has been set on zero, the work piece being sewn remains stationary to make it possible that the sewing needle 17 begins to stitch the work piece at the desired position thereof having been aligned with the sewing needle 17.

In a step (e) following the above step (d) of the flow diagram shown in FIG. 2, in case that the point of the sewing needle 17 is displaced into its depressed position under the throat plate 18, the stepping motor 25 is operated according to the feed data of the pattern data to determine the feed pitch of stitch in a step (f) subsequent to the step (e), so that the stitch is formed in the step (f).

Now, a second embodiment of the sewing machine of the present invention will be described in detail with reference to FIGS. 11 and 12.

Figure 11:
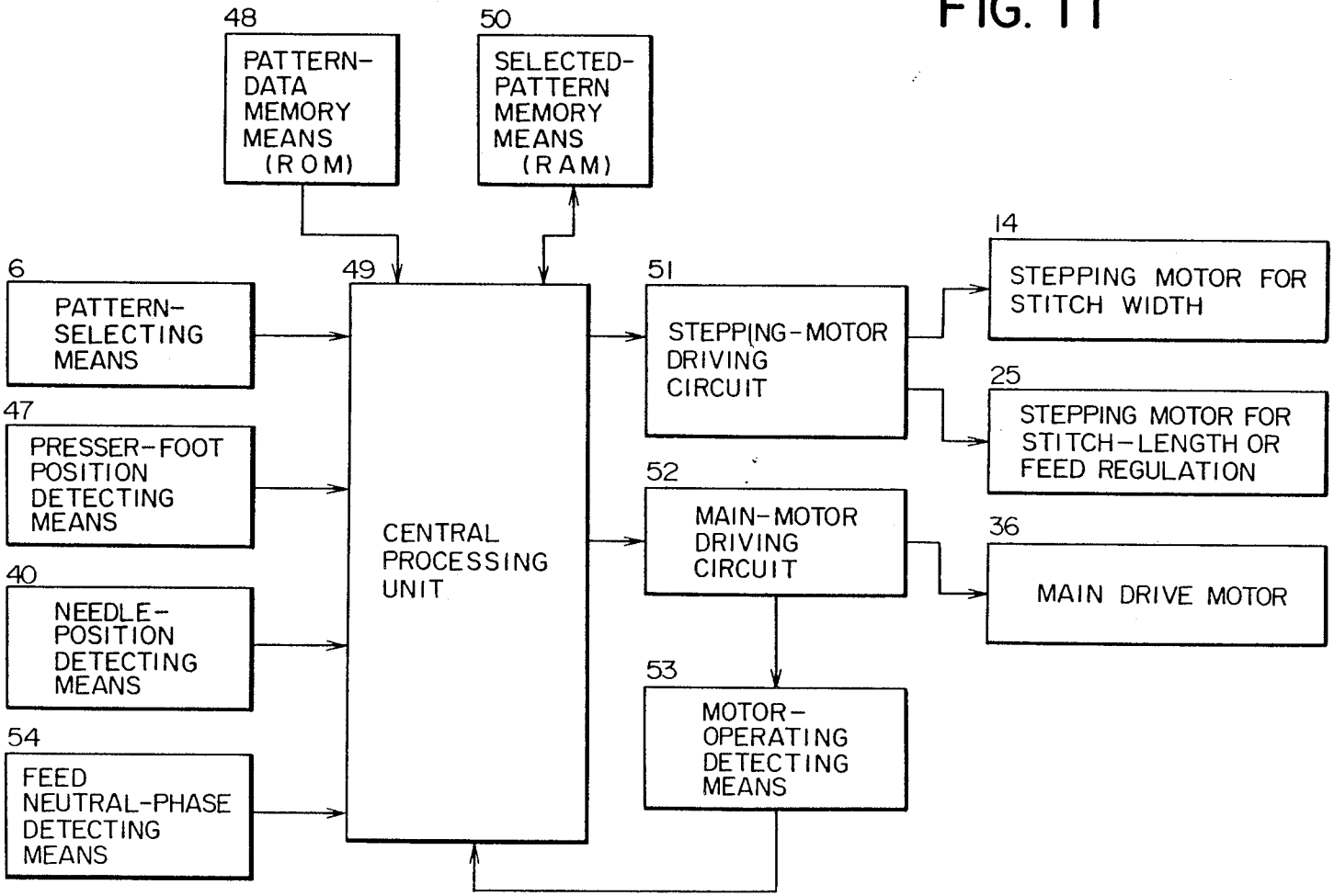
FIG. 11 is a block diagram of a control system of a second embodiment of the sewing machine of the present invention.
Figure 12:
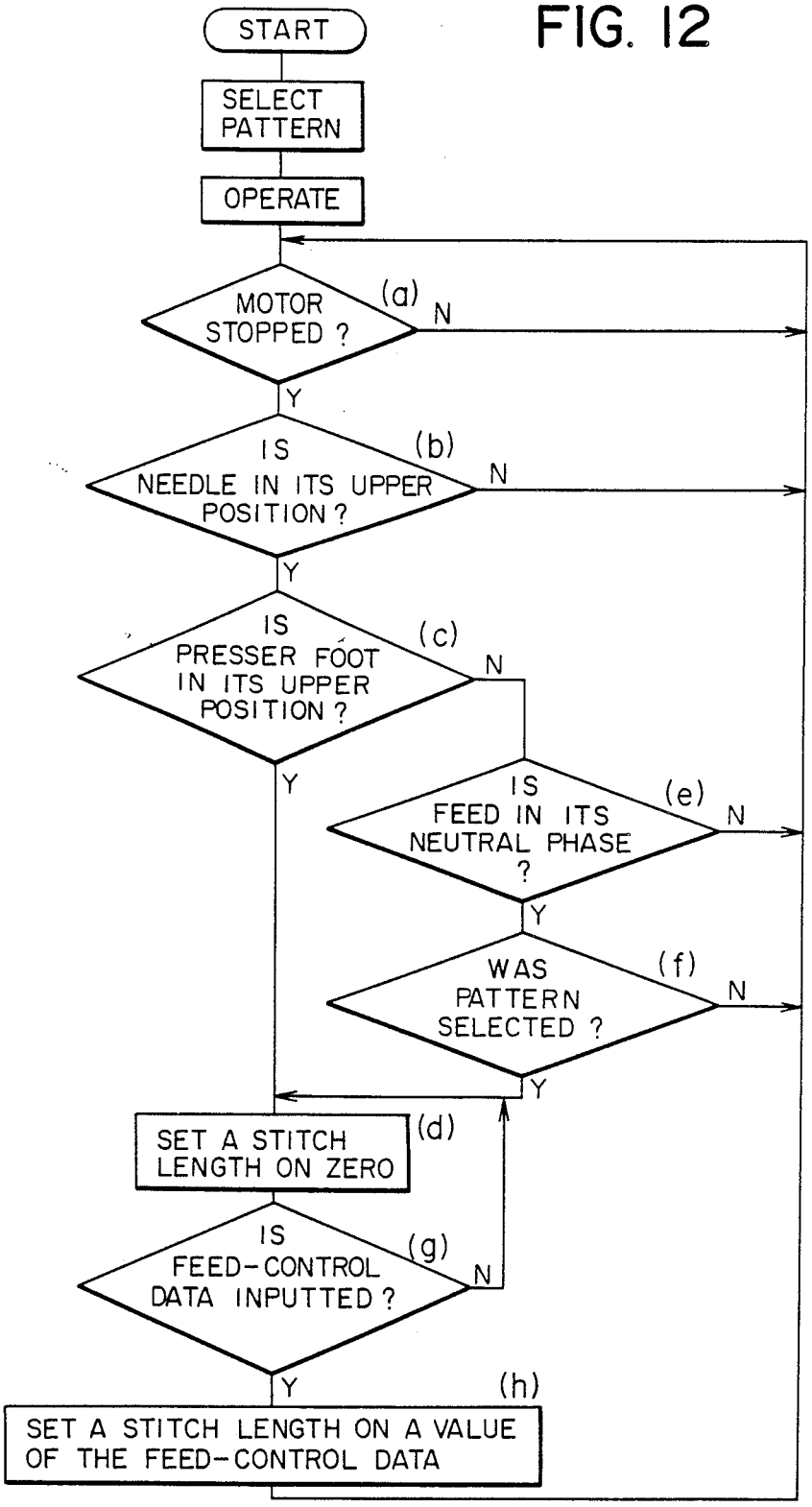
FIG. 12 is a flow diagram (flowchart) illustrating operation of the sewing machine of the present invention shown in FIG. 11.

In the second embodiment of the sewing machine of the present invention shown in FIGS. 11 and 12, the stepping motor 25 disables the feed dog 19 to accomplish a "zero feed" setting at a time when a new pattern to be stitched is selected.

The feed dog 19 is disabled in its specific phase or neutral phase.

The second embodiment of the sewing machine of the present invention is substantially similar in construction to the first embodiment of the sewing machine of the present invention. A control system of the second embodiment of the sewing machine of the present invention is shown in FIG. 11, which control system is constructed of: the control system of the first embodiment of the sewing machine of the present invention; a feed neutralphase detecting means 54; and a means for holding the neutral phase of the feed dog 19.

In the neutral phase of the feed dog 19, as shown in FIG. 7, the feed forked-rod pin 64 is substantially aligned with the center of the feed regulator 22. Consequently, in such neutral phase of the feed dog 19, it is impossible to displace the horizontal feed arm 21 even when the feed regulator 22 is rotated in a manner shown in FIGS. 6(*a*), (*c*) and (*e*).

Under such circumstances, the stepping motor 25 is easily operated, because the feed dog 19 extending upward from the throat plate 18 to abut on the presser foot 20 remains stationary. Therefore, in this case, it is possible to easily rotate the feed regulator 22 even when the presser-bar lifter 45 is not operated, whereby a feed pitch can be set on zero in a first stitch of a new pattern subsequent to the former pattern to continuously connect the new pattern with the former pattern.

Now, the control system of the second embodiment of the sewing machine of the present invention will be described in detail with reference to the flow diagram shown in FIG. 12.

First, the pattern-selecting means 6 is operated to select a desired pattern, for example such as the zigzag stitches shown in FIG. 10, and then the starting means (not shown) of the sewing machine is operated to operate the main drive motor 36 and the stepping motors 14, 25 to form the zigzag stitches.

In a step (*a*) of the flow diagram shown in FIG. 12, when the motor-operation detecting means 53 detects the stopping condition of the main drive motor, the process goes to a subsequent step (*b*). Then, in the step (*b*), in case that the needle-position detecting means 40 detects the fact that the feed dog 19 extends upward from the throat plate 18 so as to be displaced into its neutral phase or position, the process goes to a subsequent step (*c*) in which it is judged as to whether or not the presser-bar lifter 45 is operated. In case that it is judged in the step (*c*) that the presser-bar lifter 45 is operated, the stepping motor 25 for feed regulation is immediately operated to set the feed pitch of the feed dog 19 on zero.

In case that the presser-bar lifter 45 is not operated in the step (*c*), the process goes to a subsequent step (*e*) in which it is judged as to whether or not the feed dog 19 is displaced into its neutral phase or position. In case that the feed dog 19 is judged to have been displaced into the neutral phase thereof, the process goes to a subsequent step (*f*) in which it is judged as to whether or not the pattern-selecting means 6 is operated. In case that the pattern-selecting means 6 is not operated, it is judged that the main drive motor 36 is temporarily stopped, and, therefore the process jumps to the flow line followed by the step (*a*). After that, the starting means (not shown) of the sewing machine is operated again to continue the sewing operation of the zigzag stitches.

In case that the pattern-selecting means 6 is operated in the step (*d*) of the flow diagram shown in FIG. 12, it is judged that a new pattern is selected so that the stepping motor 25 for feed regulation is operated to bring the feed regulator 22 to its position shown in FIGS. 6 (*a*) and (*b*), whereby the feed pitch of the feed dog 19 is set on zero. Such "zero-feed" condition of the feed dog 19 is held until a new feed data is retrieved from the selected-pattern memory means 50.

Now, a third embodiment of the sewing machine of the present invention will be described in detail with reference to FIGS. 13 and 14.

In the third embodiment of the sewing machine of the present invention, it is possible to begin to stitch at a desired position of the work piece so as to continuously form the following stitch even when a new pattern is selected at any time during sewing operation of the former pattern.

Consequently, in the third embodiment of the present invention, it is possible to eliminate the means for detecting the specific phase or neutral position of the feed dog 19, which means is employed in the second embodiment of the present-invention. In the third embodiment of the present invention is employed a feed-dog disabling means 66 which sets the feed dog 19 at its disabled position under the throat plate 18 even when the presser-bar lifter 45 and the pattern-selecting means 6 are operated, and keeps the disabled condition of the feed dog 19 until a new feed data is retrieved from the selected-pattern memory means 50, whereby a feed pitch of a first stitch of the following stitch is set on zero to make it possible to continuously connect the following stitch with the former stitch.

Figure 13:
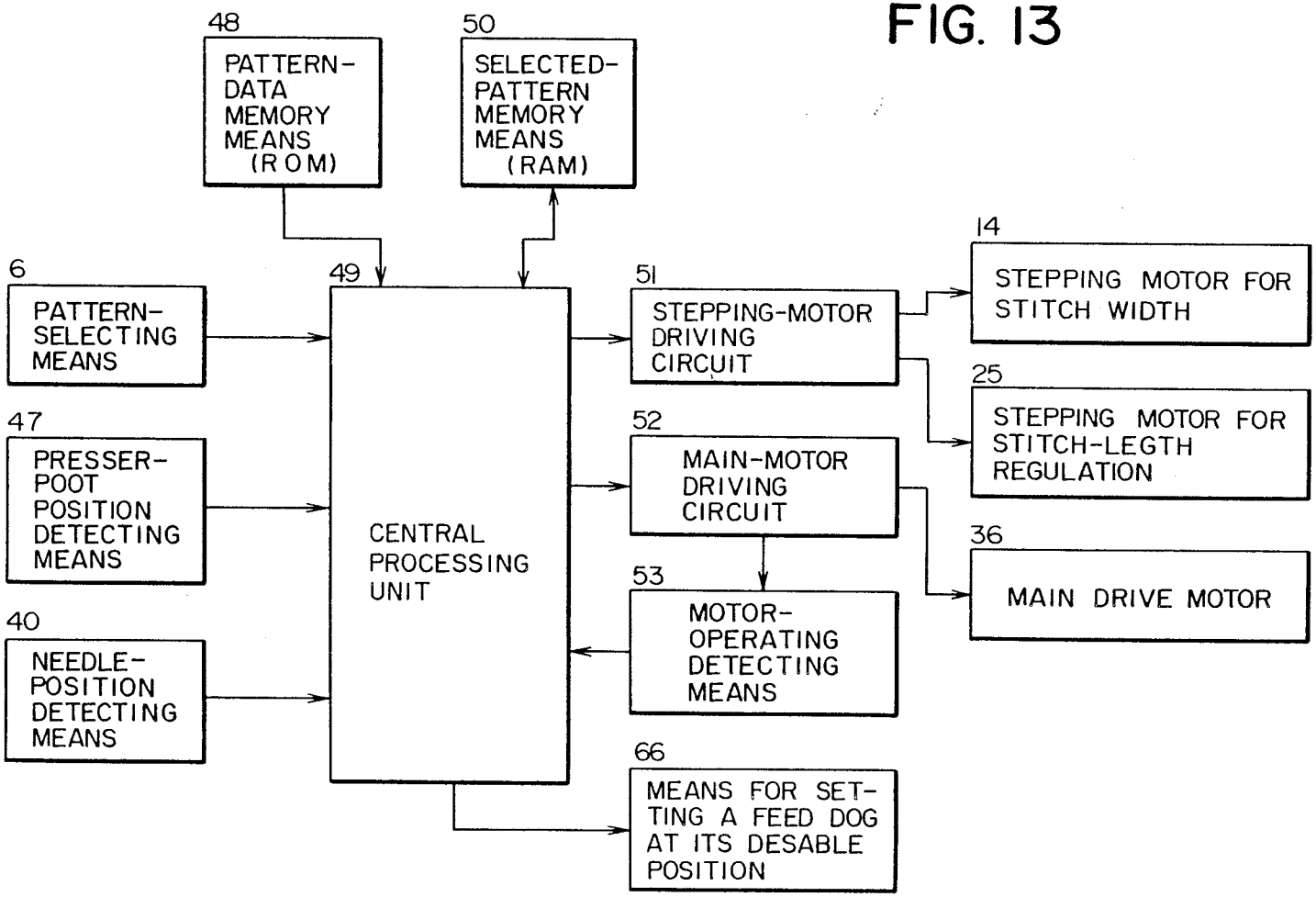
FIG. 13 is a block diagram of a control system of a third embodiment of the sewing machine of the present invention.
Figure 14:
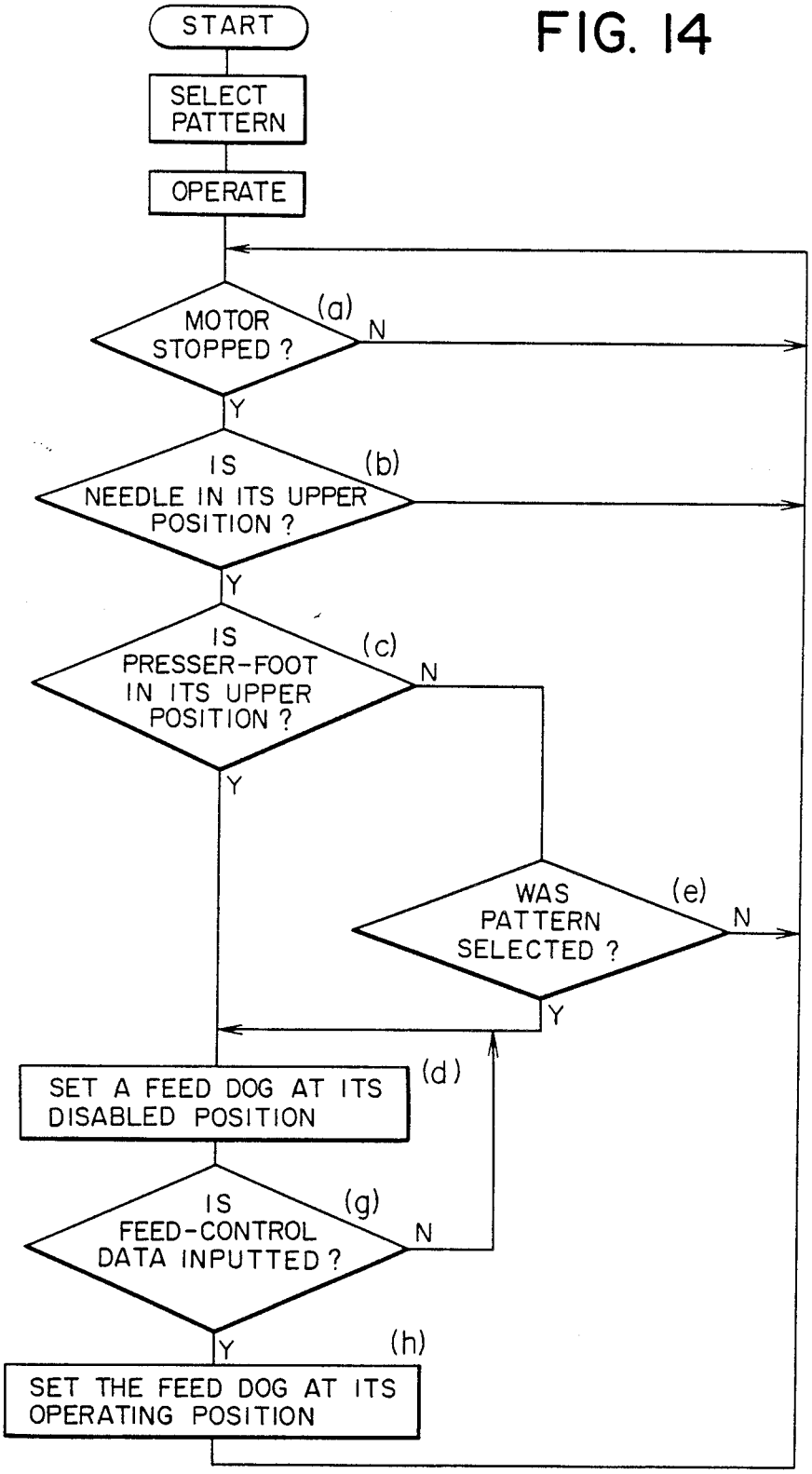
FIG. 14 is a flow diagram (flowchart) illustrating operation of the sewing machine of the present invention shown in FIG. 13.

A control system of the third embodiment of the sewing machine of the present invention is shown in FIG. 13, which control system is constructed of: the control system of the first embodiment of the present invention; and the feed-dog disabling means 66 which is disclosed in Japanese Utility Model Publication No. 57-133006, and, therefore is not described here to avoid redundancy in description.

Now, the control system of the third embodiment of the sewing machine of the present invention will be described in detail with reference to the flow diagram shown in FIG. 14.

First, the pattern-selecting means 6 is operated to select a desired pattern, for example such as the zigzag stitches shown in FIG. 10, and then the starting means (not shown) of the sewing machine is operated to operate the main drive motor 36 and the stepping motors 14, 25 to form the zigzag stitches.

In a step (*a*) of the flow diagram shown in FIG. 12, when the motor-operation detecting means 53 detects the stopping condition of the main drive motor, the process goes to a subsequent step (*b*). Then, in the step (*b*), in case that the needle-position detecting means 40 detects the fact that the feed dog 19 extends upward from the throat plate 18 so as to be displaced into its neutral phase or position, the process goes to a subsequent step (*c*) in which it is judged as to whether or not the presser-bar lifter 45 is operated. In case that it is judged in the step (*c*) that the presser-bar lifter 45 is operated, the process goes to a subsequent step (*d*) in which the feed-dog disabling means 66 is immediately operated to displace the feed dog 19 into its disabled position under the throat plate 18.

In case that the presser-bar lifter 45 is not operated in the step (*c*), the process goes to a subsequent step (*e*) in which it is judged as to whether or not the pattern-selecting means 6 is operated. In case that the pattern-selecting means 6 is not operated, it is judged that the main drive motor 36 is temporarily stopped, so that the process jumps to the flow line followed by the step (*a*), whereby the starting means (not shown) of the sewing machine is operated again to continue the sewing operation of the zigzag stitches.

In case that the pattern-selecting means 6 is operated in the step (*e*), it is judged that a new pattern is selected, whereby the feed-dog disabling means 66 is operated to bring the feed dog 19 to its disabled position under the throat plate 18. This disabled condition of the feed dog 19 is kept until a new feed data is retrieved from the selected-pattern memory means 50.

As described above, according to the present invention, by operating the presser-bar lifter 45 and the pattern-selecting means 6, a feed pitch of a first stitch of the following sewing operation may be set on zero. As a result, it is possible to continuously connect the following stitch with the former stitch so that an assembly of continuous patterns is easily formed according to the present invention.

What is claimed is:

1. A sewing machine of the kind having a machine drive motor driven to rotate a drive shaft to reciprocate vertically a machine needle between an upper position and a lower position, the needle being swingable laterally of a fabric feeding direction, a fabric feeding mechanism including a feed dog, first means for moving the feed dog between a lower position under a throat plate and an upper position above the throat plate, second means for moving the feed dog in the fabric feeding direction when the feed dog is located above the throat plate, a feed regulator operatively connected to the second means, an actuator operatively connected to the feed regulator and arranged to displace the feed regulator angularly to adjust the moving amount of the feed dog in the fabric feeding direction, and a presser foot arranged to be manually operated between an upper position at which the presser foot is spaced from the throat plate and a lower position at which the presser foot is pressed against the throat plate and which cooperates with the feed dog to transport the fabric placed therebetween in the fabric feeding direction with respect to the machine needle, and memory means having pattern data stored therein including specific feed adjusting data, said sewing machine comprising:

first detecting means for detecting if said machine drive motor is driven or stopped;

second detecting means for detecting if said machine needle is located at its upper position or its lower position;

third detecting means for detecting if said presser foot is located at its upper position or its lower position; and control means operative in response to a condition wherein said first detecting means detects that the machine drive motor is stopped, said second detecting means detects that said machine needle is at its upper position and said third detecting means detects that said presser foot is at its upper position, including means for reading out said specific feed adjusting data from said memory means to drive said actuator, and for angularly displacing said feed regulator to a specific position at which the moving amount of said feed dog is reduced to zero.

2. A sewing machine of the kind having a machine drive motor driven to rotate a drive shaft to reciprocate vertically a machine needle between an upper position and a lower position, the needle being swingable laterally of a fabric feeding direction, a fabric feeding mechanism including a feed dog, first means for moving the feed dog between a lower position under a throat plate and an upper position above the throat plate through a neutral position, second means for moving the feed dog in the fabric feeding direction when the feed dog is located above the throat plate, a feed regulator operatively connected to the second means, an actuator operatively connected to the feed regulator and arranged to displace the feed regulator angularly to adjust the moving amount of the feed dog in the fabric feeding direction, and a presser foot arranged to be manually operated between an upper position at which the presser foot is spaced from the throat plate and a lower position at which the presser foot is pressed against the throat plate and which cooperates with the feed dog to transport the fabric placed therebetween in the fabric feeding direction with respect to the machine needle, memory means having pattern data stored therein for a plurality of different patterns to be stitched, and pattern selecting means selectively operated to select the patterns, said memory means having specific feed adjusting data stored therein, said sewing machine comprising:

first detecting means for detecting if said machine drive motor is driven or stopped;

second detecting means for detecting if said machine needle is located at its upper position or its lower position;

third detecting means for detecting if said presser foot is located at its upper position or its lower position; and fourth detecting means for detecting if the feed dog is at the neutral position;

fifth detecting means for detecting if said pattern selecting means is operated to select a pattern; and control means operative in response to a condition wherein said first detecting means detects that the machine drive motor is stopped, said second detecting means detects that said machine needle is at its upper position, said third detecting means detects that said presser foot is at its lower position, said fourth detecting means detects that the feed dog is at the neutral position, and the fifth detecting means detects that pattern selecting means is operated, including means for reading out said specific feed adjusting data from said memory means to drive said actuator, and for angularly displacing said feed regulator to a specific position at which the moving amount of said feed dog is reduced to zero.

3. A sewing machine of the kind having a machine drive motor driven to rotate a drive shaft to reciprocate vertically a machine needle between an upper position and a lower position, the needle being swingable laterally of a fabric feeding direction, a fabric feeding mechanism including a feed dog, first means for moving the feed dog between a lower position under a throat plate and an upper position above the throat plate, second means for moving the feed dog in the fabric feeding direction when the feed dog is located above the throat plate, a feed regulator operatively connected to the second means, an actuator operatively connected to the feed regulator and arranged to displace the feed regulator angularly to adjust the moving amount of the feed dog in the fabric feeding direction, and a presser foot arranged to be manually operated between an upper position at which the presser foot is spaced from the throat plate and a lower position at which the presser foot is pressed against the throat plate and which cooperates with the feed dog to transport the fabric placed therebetween in the fabric feeding direction with respect to the machine needle, memory means having pattern data stored therein for a plurality of different patterns to be stitched, and pattern selecting means selectively operated to select the patterns, said memory means having specific feed adjusting data stored therein, said sewing machine comprising:

first detecting means for detecting if said machine drive motor is driven or stopped;

second detecting means for detecting if said machine needle is located at its upper position or its lower position;

third detecting means for detecting if said presser feet is located at its upper position or its lower position; and fourth detecting means for detecting if said pattern selecting means is operated to select a pattern; and control means operative in response to a condition wherein said first detecting means detects that the machine drive motor is stopped, said second detecting means detects that said machine needle is at its upper position, said third detecting means detects that said presser foot is at its lower position, and the fourth detecting means detects that said pattern selecting means is operated, including means for reading out said specific feed adjusting data from said memory means to drive said actuator, and for angularly displacing said feed regulator to a specific position at which the moving amount of said feed dog is reduced to zero.

* * * * *